United States Patent [19]

Herman

[11] Patent Number: 4,480,934

[45] Date of Patent: Nov. 6, 1984

[54] BALLISTIC PRINT WIRE ACTUATOR USING A TELESCOPIC ARMATURE

[75] Inventor: Richard L. Herman, Sebring, Fla.

[73] Assignee: International Business Machines Corporation, Armonk, N.Y.

[21] Appl. No.: 451,683

[22] Filed: Dec. 20, 1982

[51] Int. Cl.[3] ..... B41J 3/12

[52] U.S. Cl. ..... 400/124; 101/93.05; 335/261

[58] Field of Search ..... 400/124; 101/93.05; 335/259, 261, 264

[56] References Cited

U.S. PATENT DOCUMENTS

| | | | |
|---|---|---|---|
| 3,961,298 | 6/1976 | Jaffe et al. | 335/259 |
| 4,211,496 | 7/1980 | Naylor | 400/124 |
| 4,230,411 | 10/1980 | Grottrup | 400/124 X |

OTHER PUBLICATIONS

*IBM Tech. Disc. Bulletin*, by L. R. Siegl, vol. 23, No. 8, Jan. 1981, pp. 3545–3546.

*Primary Examiner*—Paul T. Sewell

*Attorney, Agent, or Firm*—David D. Bahler; J. Jancin, Jr.

[57] ABSTRACT

A print wire actuator using a telescopic armature pair is presented. The actuator is disposed to propel a print wire through a predetermined distance from a rest position toward a recording medium. The armature pair moves by electromagnetic force over a first portion of the predetermined distance at which point one piece of the armature reaches a mechanical stop. The second piece of the armature continues to move, both ballistically and magnetically, over the remaining portion of the predetermined distance.

7 Claims, 4 Drawing Figures

BALLISTIC PRINT WIRE ACTUATOR USING A TELESCOPIC ARMATURE

DESCRIPTION

1. Technical Field

This invention relates to a print wire actuator capable of producing a long wire stroke with high impact force while requiring a low electrical drive power.

2. Background Art

Fragmentary or matrix type printers are well known in the art. In such printers, characters are formed on a recording medium by a plurality of dots selected from a standard matrix of dots. A typical matrix is 5 dots wide by 7 dots high, but can be of any dimensions. Matrix printers are often constructed using a plurality of print wires each of which is propelled by a cooperating electromagnetic actuator to impact the recording medium. Each dot of the matrix is formed by a single wire and a typical print head will have several wires with an equal number of corresponding actuators.

In a conventional background art actuator, the print wire is affixed to a movable armature constructed from magnetic material. The armature is placed along the longitudinal axis of a wire coil solenoid offset from the geometric center of the coil. When electrical current is applied to the coil, a magnetic flux is established along the axis of the coil producing an electromagnetic force thrusting the armature and wire from a rest position toward the recording medium. The wire impacts the recording medium, producing a dot, and then rebounds with the armature back to the the rest position. The actuator is then ready for another coil energizing, producing another actuation sequence. The rebound to the rest position is often aided by a position return means such as a magnet or a mechanical spring. This conventional actuator uses a minimum of mechanical parts and thereby enjoys high reliability. However, if a long armature stroke is required, the current supplied to the solenoid must be maintained for a longer period of time corresponding to the increased stroke length. Also, if a high print wire impact force is desired, the armature and print wire must be accelerated to a higher velocity before impacting the recording medium and the magnitude of the current supplied to the solenoid must be increased to effect the increased acceleration. In either of these situations (maintaining the current for a longer stroke, or increasing the current for a higher impact force), the electrical power consumed by the print actuator will increase. Considering the summation of the power consumed by each of the plurality of actuators in a given print head, the total power requirement may prove unacceptable or even prohibitive.

In a typical print wire actuator, a short stroke length is considered to be in the range of 0.012 to 0.018 inches, and a low wire impact force is considered to be approximately two pounds. Conversely, on the order of 0.030 inches is considered to be a long wire stroke and a high wire impact force is considered to be in the range of 4 to 6 pounds.

A particular conventional background art actuator has a short stroke of 0.015 inches and a high wire impact force of five pounds. The energy required by this actuator is approximately 0.008 Joules per wire thrust. Increasing the stroke length of this actuator to 0.030 inches while maintaining the impact force of five pounds would require approximately 50% more energy or 0.012 Joules total.

Another type of background art print wire actuator is a ballistic actuator which also uses an electrical coil solenoid with a nested, movable magnetic material armature. Energizing the coil will again cause the armature to move. In a ballistic actuator, the print wire is not attached to the armature, but instead the end of the wire is positioned so as to be impacted by the armature when the armature is near the end of its stroke. The impact will cause the wire to bounce off of the armature and be propelled from a rest position toward the recording medium. The print wire then travels or "flies" until it impacts the recording medium producing a dot. During this fly time, the print wire is moving under its own momentum and is no longer in contact with the armature. Therefore, the travel is accurately described as ballistic. After impacting the record medium, the wire rebounds back to its rest position often aided by a return spring or magnet. The actuator is then ready for another actuation sequence. A ballistic actuator is capable of long wire stroke with low electrical power due to the relatively short stroke of the armature. However, ballistic actuators typically require more mechanical parts than a conventional actuator and therefore suffer reduced reliability. Also, the collision between the print wire and armature may be very violent and may eventually cause mechanical deformation or failure of the impacting surfaces. Another disadvantage of the ballistic actuator is a lower recording medium impact force due to the fact that the wire is travelling under its own momentum rather than being constantly driven by an electromagnetic force.

It would therefore be desirable to have a print wire actuator capable of producing a long wire stroke with high recording medium impact force while requiring a low electrical drive power.

SUMMARY OF THE INVENTION

The invention as herein described and claimed solves the drawbacks of the background art actuators. The invention is a print wire actuator capable of producing a long print wire stroke or a high print wire impact force or both while requiring a low drive power and while maintaining high reliability.

The invention uses a two-piece, telescopic magnetic material armature assembly instead of the unitary armature used in prior print wire actuators. The larger, primary armature is partially hollow and has nested therein a secondary armature or plunger which is fixed to the print wire. The telescopic armature pair is positioned within a wire coil solenoid along the longitudinal axis of the coil so that both armatures are movable along the axis. When the coil is energized, the two armatures move together for a first given distance at the end of which the primary armature reaches a mechanical stop. Thereafter, the nested plunger armature continues to move with the print wire a distance greater than the first given distance. The continued movement of the secondary armature plunger is due partially to the electromagnetic force acting on the secondary armature generated by the energized coil, and partially to the momentum imparted to the secondary armature by the simultaneous movement of the two armatures over the first given distance. The preferred embodiment of the invention is therefore a novel combination of some features from a conventional actuator with other features from a ballistic actuator.

An actuator constructed using this telescopic armature can have a long wire stroke of approximately 0.030 inches and a high wire impact force of approximately five pounds while using only around 0.008 Joules of energy. This is contrasted with 0.012 Joules for a conventional actuator.

The primary object of this invention is to provide a print wire actuator capable of producing a long print wire stroke with high recording medium impact force while requiring low electrical power consumption.

Another object of the invention is to provide a print wire actuator capable of producing a long print wire stroke with a high recording medium impact force while maintaining the high mechanical reliability of a conventional actuator.

Yet another object of the invention is to provide a print wire actuator that combines the attributes of ballistic motion and electromagnetic force during the stroke of the print wire. The invention will produce a long wire stroke with low electrical power consumption which is similar to a ballistic actuator, but which is uncharacteristic of a conventional actuator. However, unlike a ballistic actuator, the electromagnetic force acting on the secondary armature during its extended motion provides a high wire impact force similar to the action of a conventional actuator.

Other features, advantages and extensions of the invention will be apparent from the following more detailed description of the preferred embodiment of the invention as illustrated in the accompanying drawings.

DETAILED DESCRIPTION OF THE PREFERRED EMBODIMENT

Figure 1:
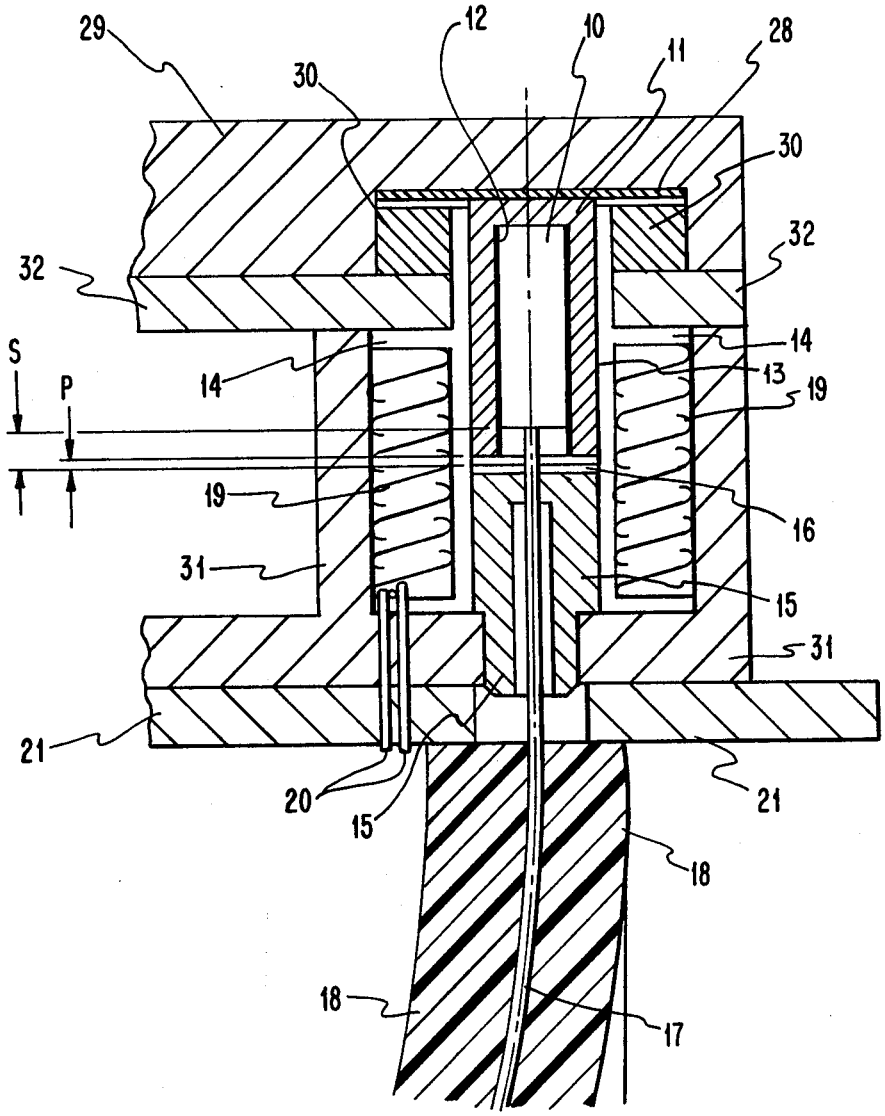
FIG. 1 is a longitudinal cross section view of the print wire actuator of the present invention showing the rest position of the two-piece armature assembly when the solenoid is de-energized.
Figure 2:
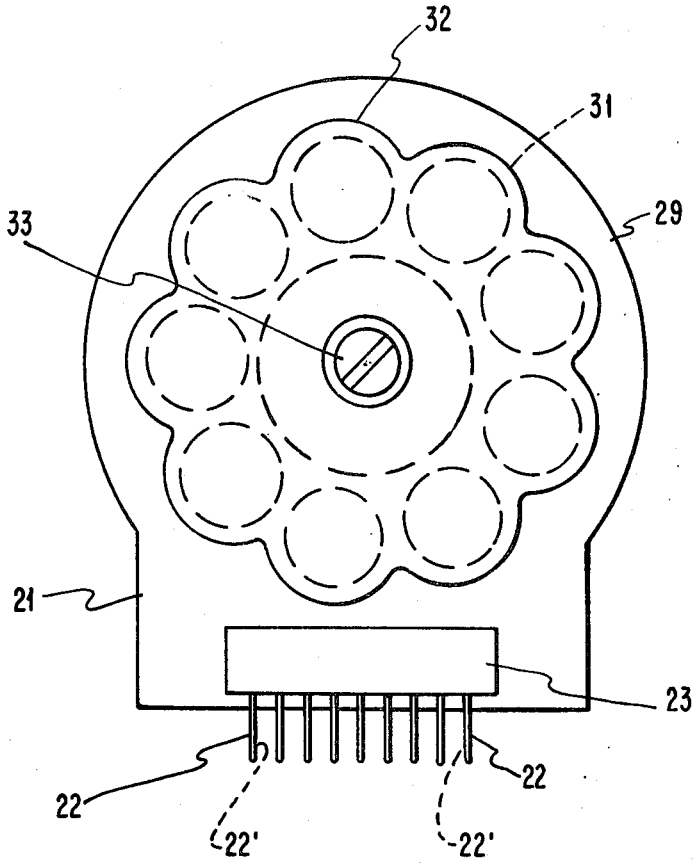
FIG. 2 is a top view of a print head incorporating nine actuators like that of FIG. 1.
Figure 3:
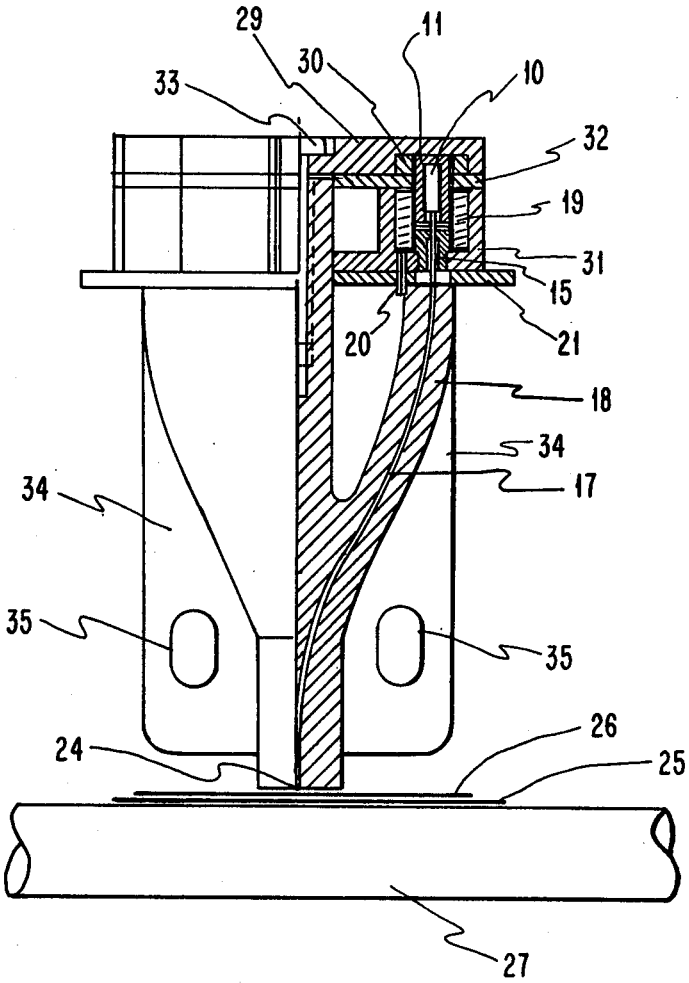
FIG. 3 is a partial longitudinal cross section of the print head of FIG. 2 showing a print wire actuator of FIG. 1.

The preferred embodiment is the print wire actuator shown in FIG. 1. A plurality of such actuators can be assembled into a print head as shown in FIGS. 2 and 3.

Referring to FIG. 1, an armature 10 (hereinafter referred to as plunger 10), made of magnetic material such as a silicon-iron alloy is telescopically nested within another armature 11 made of a similar magnetic material. The interface 12 between plunger 10 and armature 11 is a long wearing bearing-type material such as nylon, for example, to insure smooth, non-binding operation of plunger 10 and armature 11 during the operating life of the actuator. The interface 12 can be formed by jacketing plunger 10 or by coating the interior surface of armature 11.

The armature assembly is slideably engaged within a longitudinal passage 13 of a bobbin 14. The cross-section of longitudinal passage 13 will preferably be circular but it is understood that any shape can be used as long as the cross sections of passage 13 and the perimeter of armature 11 have complimentary shapes. For example, the cross-section of passage 13 could be square or triangular with the perimeter of nested armature 11 being a complimentary square or triangle respectively. Likewise, plunger 10 and interior surface 12 of armature 11 are preferably circular in cross section, but again, any complimentary shapes will serve the objects of this invention.

The bobbin 14 is made of electrically insulating, bearing-type material such as nylon, for example, in order to provide a low friction interface with sliding armature 11.

Also disposed in passage 13 is a core piece 15. The core piece 15 is constructed of magnetic material such as a silicon-iron alloy and is fixedly mounted within passage 13. The core piece 15 and each piece of the armature assembly (armature 11 and plunger 10) define two air gaps. The primary air gap P is measured between core piece 15 and armature 11, and the longer secondary air gap S is measured between core piece 15 and telescoping plunger 10. In practice, the primary air gap P is approximately 0.005 inches and the secondary air gap S is approximately 0.030 inches, however, other gap lengths will also meet the objects of this invention.

A cushion piece 16 covers the end of core piece 15 and cushions the core piece 15 from the impact of armature 11. The cushion piece 16 also maintains a small air gap between armature 11 and core 15 when armature 11 is moved from the rest position shown in FIG. 1 to a position abutting core 15. Maintaining a small air gap is desirable to insure sufficient magnetic flux through the plunger 10 thereby maintaining a high electromagnetic force on the plunger 10 when the armature 11 abutts core 15.

One end of print wire 17 is fixedly attached to plunger 10 and is movable with plunger 10. The wire 17 is routed through a hole in cushion piece 16 and through a hole in core 15 to a wire path guide 18. The wire 17 is moved with plunger 10 when plunger 10 is projected toward core 15. The wire path guide 18 is made from a bearing-type material such as nylon to maintain low friction cooperation between wire 17 and wire path guide 18.

The bobbin 14 has wound, in a recess thereon, a wire coil solenoid 19 with leads 20 attached to circuit traces (not shown) on the surface of a printed circuit board 21. The circuit traces terminate at pairs of connector pins 22 and 22' (see also FIG. 2) mounted in a connector housing 23. When the solenoid is energized by a power source (not shown) connected to connector pins 22 and 22', current flows in the solenoid and a magnetic flux is produced in the axial direction of the solenoid 19 forcing armature 11 plunger 10 from the rest position shown in FIG. 1 toward core piece 15, thereby compressing air gaps P and S. The print wire 17 moves with plunger 10 and slides along the wire path guide 18.

During actuation, plunger 10 and armature 11 move together for a first distance equal to primary air gap P at which point the armature collides with cushion piece 16 covering the core piece 15. The plunger 10 and print wire 17 continue to move through a second distance. During a portion of the continued travel of plunger 10 and wire 17, there is an electromagnetic force acting on the plunger due to the magnetic flux produced by energized solenoid 19. During a second portion of the continued travel of the plunger 10 and wire 17, the solenoid is deenergized so that the wire and plunger move due to the momentum imparted to plunger 10 and wire 17 during the simultaneous movement of plunger 10 and armature 11 over the first given distance represented by the primary air gap P. The timing relationships of the solenoid energization current with the motions of plunger 10 and armature 11 will be described in detail later in the discussion relating to FIG. 4.

Referring now to FIG. 3, print wire 17 and print wire end 24 move with plunger 10 until print wire end 24 impacts recording medium 25. The recording medium is typically a sheet of paper arranged with an ink carrying member 26, usually a ribbon, and a resilient platen 27 to produce ink dots on the recording medium.

After impacting the recording medium, print wire 17 and plunger 10 rebound back toward the rest position shown in FIG. 1. While returning to the rest position, plunger 10 will reunite with armature 11, and the two will move as a pair back to the rest position. Back stop 28 cushions the impact of returning armature 11 as it collides with back plate 29.

In the preferred embodiment shown in FIG. 1, permanent magnet 30 retains armature 11 and plunger 10 in the rest position in anticipation of the next actuation sequence. An alternate means of providing the same retention function would be to use a mechanical spring between plunger 10 and core piece 15. The spring would be disposed to urge the armature assembly toward the rest position.

The force supplied by either retention means (magnet 30 or a mechanical spring) is much less than the electromagnetic force supplied to the armature assembly by solenoid 19. Therefore, the retention means is only effective to hold the armature assembly in the rest position when solenoid 19 is de-energized.

Flux block 31 and flux disk 32 are used to provide a low reluctance return path for the magnetic flux produced by solenoid 19. This increases the efficiency of the actuator. The flux block 31 is typically constructed from a magnetic material such as a silicon-iron alloy and is shaped to accommodate multiple actuators as shown, for example, in FIGS. 2 and 3. The flux disk 32 is also constructed of magnetic material such as a silicon-iron alloy and is also formed to accommodate multiple actuators.

The completed print head shown in FIGS. 2 and 3 is held together in assembled form by a screw 33. Flange pieces 34 are provided with mounting holes 35 to facilitate the mounting and aligning of the print head in a printer.

Figure 4:
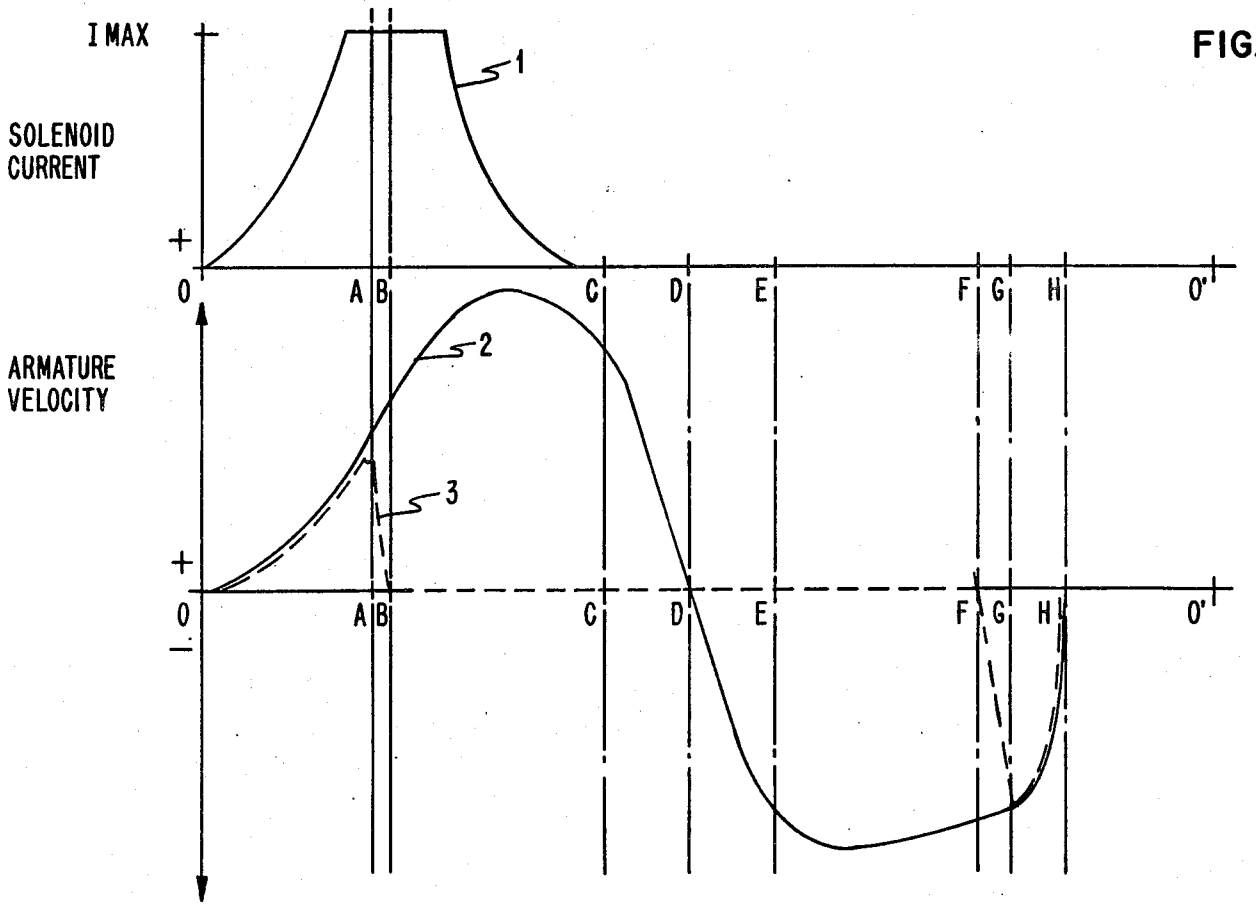
FIG. 4 is a time plot of the current in the solenoid of the actuator along with the velocities of each piece of the armature assembly during a typical actuation sequence.

FIG. 4 shows two graphs illustrating the time relationship of the solenoid current, the velocity of armature 11, and the velocity of plunger 10 of the actuator in FIG. 1, during a complete actuation sequence. The upper graph shows the solenoid current wave shape 1, and the lower graph shows the velocity of the armature 11 by dashed line 3 and the velocity of the plunger 10 by solid line 2. The abscissa of each graph is time, and the two graphs show an actuation sequence for identical time intervals.

Positive current in solenoid 19 (see also FIG. 1) causes a magnetic flux to be established whereby an electromagnetic force causes plunger 10 and armature 11 to move toward core piece 15. Also, as armature 11 and plunger 10 move toward the core piece, their velocity is deemed positive and, conversely, as armature 11 and plunger 10 move away from the core piece 15, their velocity is characterized negative. The print wire 17 is fixed to the plunger 10 and, therefore, the velocity of print wire 17 and its print wire end 24 is the same as the velocity of plunger 10.

The graphs of FIG. 4 are presented for illustrative purposes only and are not to be considered to delimit the subject invention in any manner.

At the time instant of origin O, the current in solenoid 19 is zero and armature 11 and plunger 10 are in the rest position as illustrated in FIG. 1.

During the interval O-A, the current builds in solenoid 19 and eventually reaches a maximum value. A typical maximum magnitude for the solenoid current IMAX is on the order of three amperes. The current in solenoid 19 produces an electromagnetic force that causes armature 11 and plunger 10 to accelerate as shown by the increasing velocity waveforms 2 and 3 in FIG. 4. Also during interval O-A, the primary and secondary air gaps P and S are collapsing at the same rate as armature 11 and plunger 10 simultaneously move toward the core piece 15.

At time A, the armature 11 collides with cushion piece 16 covering core piece 15. During the time interval A-B, armature 11 quickly decelerates and comes to rest at time B abutted to core piece 15 separated only by the cushion piece 16.

As displayed by waveform 2, plunger 10 and print wire 17 continue to accelerate during and after time interval A-B. At time instant A, plunger 10 begins to slide within armature 11 and, at time instant B, the primary air gap P is completely compressed as the secondary air gap S continues to collapse.

During interval B-C, the current in solenoid 19 extinguishes, but plunger 10 and print wire 17 continue to move with a positive velocity. The motion of plunger 10 during interval B-C is due partially to the electromagnetic force provided by the solenoid when there is current in the solenoid and is due partially to the momentum of plunger 10 and print wire 17 gained since time instant 0. After the solenoid current reaches zero during time interval B-C, the motion of plunger 10 and print wire 17 is due totally to momentum and as such this motion can be termed purely ballistic.

At time C, print wire end 24 (see also FIG. 3) contacts recording medium 25 and plunger 10 and print wire 17 begin a fast deceleration.

During time interval C-D, print wire end 24 deforms the surface of resilient platen 27 beneath recording medium 25 and, in the process, transfers all of the mechanical energy from plunger 10 and print wire 17 to resilient platen 27. At time D, the plunger 10 and print wire 17 are instantaneously at rest and the pair have moved to the pinnacle of displacement from the rest position illustrated in FIG. 1. At time instant D, the secondary air gap S has not been completely collapsed as the total displacement of plunger 10 during a normal actuation sequence is less than the secondary air gap S.

During interval D-E, the mechanical energy stored by resilient platen 27 during time interval C-D is returned to the plunger/print wire combination. The negative velocity shown by waveform 2 indicates that plunger 10 and print wire 17 have reversed direction and are now returning to the rest position shown in FIG. 1. At time E, print wire end 24 looses contact with the recording medium 25.

The plunger 10 and print wire 17 continue to move back toward the rest position during interval E-F and at time instant F, plunger 10 returns to a nested position with armature 11.

The armature 11 accelerates to the velocity of plunger 10 during interval F-G and the pair returns simultaneously to the rest position at time instant H.

There is very little bounce at time instant H because back stop piece 28 cushions the blow of armature 11 against back plate 29 and since the retention means (magnet 30) holds armature 11 and plunger 10 in the rest position.

After time instant H, the actuator is again ready for energization of solenoid 19 causing another print wire thrust. Another actuation cycle could start at any time after time instant H and this is exhibited by a new instant of origin O'. The time required for an entire actuation sequence as represented by interval O-H is approximately 0.001 seconds.

It will be understoond that the preferred embodiment herein presented is for illustrative purposes, and, as such, will not be construed to place limitations on the invention. Those skilled in the art will understand that changes in the form and detail of the preferred embodiment recited may be made without departing from the spirit and scope of the invention.

I claim:

1. A print wire actuator for propelling a print wire from a zero velocity rest position through a predetermined distance into a recording medium comprising:

an armature assembly including:

a longitudinally moveable armature; and a movable plunger, fixedly attached to said print wire, and slidably positioned within said armature;

electromagnetic means energizable to propel said armature assembly toward said recording medium;

electromagnetic means energizable to propel said armature assembly toward said recording medium;

whereby energization of said electromagnetic means propels said armature assembly a first portion of said predetermined distance, and thereafter, propels said plunger, ballistically and magnetically, toward said recording medium through the remainder of said predetermined distance.

2. A print wire actuator for propelling a print wire from a zero velocity rest position through a predetermined distance into a recording medium comprising:

an armature assembly including;

a longitudinally movable armature constructed of magnetic material; and a movable plunger constructed of magnetic material, fixedly attached to said print wire and, slideably positioned within said armature;

electromagnetic means energizable to propel said armature assembly toward said recording medium;

retention means for retaining said armature assembly in said rest position when said electromagnetic means is de-energized;

whereby energization of said electromagnetic means overcomes said retention means to propel said armature assembly a first portion of said predetermined distance and, thereafter, to project said plunger, ballistically and magnetically, toward said recording medium through the remainder of said predetermined distance.

3. A print wire actuator according to claim 2 wherein said magnetic material is a silicon-iron alloy.

4. A print wire actuator according to claim 2 wherein said retention means is a magnet.

5. A print wire actuator according to claim 2 wherein said electromagnetic means is a wire coil solenoid.

6. A matrix wire printer including a plurality of print wires, wherein each wire is disposed to be propelled from a zero velocity rest position through a predetermined distance into a recording medium by a respective one of an equal number of actuators, each actuator comprising:

an armature assembly including;

a longitudinally movable armature constructed of magnetic material;

a movable plunger constructed of magnetic material, affixed to said print wire and, slideably positioned within said armature;

electromagnetic means energizeable to propel said armature assembly toward said recording medium;

retention means for retaining said armature assembly in said rest position when said electromagnetic means is de-energized;

whereby energization of said electromagnetic means overcomes said retention means to propel said armature assembly a first portion of said predetermined distance, and, thereafter, to project said plunger, ballistically and magnetically, toward said recording medium through the remainder of said predetermined distance.

7. A printer according to claim 6 wherein said recording medium includes:

an ink carrying member;

a resilient platen member; and a recording paper intermediate said ink carrying and platen members;

whereby ink is transferred from said ink carrying member to said paper supported by said platen member when said print wire is propelled into said recording medium.

* * * * *

UNITED STATES PATENT AND TRADEMARK OFFICE

CERTIFICATE OF CORRECTION

PATENT NO. : 4,480,934

DATED : November 6, 1984

INVENTOR(S) : Richard L. Herman

It is certified that error appears in the above-identified patent and that said Letters Patent is hereby corrected as shown below:

Column 7 Delete lines 30-31.

Signed and Sealed this

*Sixteenth* Day of *April 1985*

[SEAL]

*Attest:*

DONALD J. QUIGG

*Attesting Officer* *Acting Commissioner of Patents and Trademarks*